US011837793B2

(12) United States Patent
Bhattacharya et al.

(10) Patent No.: US 11,837,793 B2
(45) Date of Patent: Dec. 5, 2023

(54) WIDEBAND WIDE-BEAMWIDTH POLARIZATION DIVERSE ANTENNA

(71) Applicant: SWIFTLINK TECHNOLOGIES INC., Richmond (CA)

(72) Inventors: Abhijit Bhattacharya, Burnaby (CA); Min-Yu Huang, Richmond (CA)

(73) Assignee: SWIFTLINK TECHNOLOGIES INC., Richmond (CA)

( * ) Notice: Subject to any disclaimer, the term of this patent is extended or adjusted under 35 U.S.C. 154(b) by 0 days.

(21) Appl. No.: 17/665,079

(22) Filed: Feb. 4, 2022

(65) Prior Publication Data

US 2023/0253719 A1 Aug. 10, 2023

(51) Int. Cl.

| | |
|---|---|
| ***H01Q 21/26*** | (2006.01) |
| ***H01Q 1/24*** | (2006.01) |
| ***H01Q 21/06*** | (2006.01) |

(52) U.S. Cl.

CPC ..... *H01Q 21/26* (2013.01); *H01Q 1/243* (2013.01); *H01Q 21/062* (2013.01)

(58) Field of Classification Search

CPC ..... H01Q 21/062; H01Q 1/243; H01Q 21/26

See application file for complete search history.

(56) References Cited

U.S. PATENT DOCUMENTS

2022/0158333 A1* 5/2022 Smith ..... H01Q 1/28

* cited by examiner

*Primary Examiner* — Graham P Smith

(74) *Attorney, Agent, or Firm* — WOMBLE BOND DICKINSON (US) LLP

(57) ABSTRACT

An antenna includes a first radiating arm comprising a first radiating element having a first outer edge, and a second radiating arm that is arranged orthogonally on the first radiating arm and separated from the first radiating arm in a first direction, the second radiating arm comprising a second radiating element having a second outer edge. The first outer edge of the first radiating element extends substantially parallel to the second outer edge of the second radiating element.

18 Claims, 15 Drawing Sheets

WIDEBAND WIDE-BEAMWIDTH POLARIZATION DIVERSE ANTENNA

TECHNICAL FIELD

This disclosure relates generally to antennas, and in particular to wideband polarization diverse antennas.

BACKGROUND

Wireless communication systems have historically undergone a revolution about once in every decade. Presently, $5^{th}$ Generation (5G) wireless technology is out of its exploratory research phase, and the first wave of commercialization of 5G is being experienced, with its widespread adaptation anticipated by 2025. One of the benefits of 5G includes a much higher system capacity (100 to 1000 times more) than the current 4G systems. One of the approaches in achieving this several orders of magnitude increase in system capacity will be to exploit large quantities of new system bandwidth. This is prompting the migration towards higher frequencies, particularly in the millimeter-wave ("mmWave") region of the spectrum which will release a large amount of bandwidth available to achieve higher capacity. The mmWave spectrum is the band of spectrum between 30 GHz and 300 GHz. Worldwide various standards organizations such as the international telecommunication union (ITU), the Federal Communications Commission (FCC) in the US, and the Ministry of Industry and Information Technology (MIIT) in China have already announced several mmWave bands for 5G systems.

In addition to moving to mmWave frequencies, another way to achieve increased system capacity is to use MIMO (multiple input multiple output) techniques. In MIMO, antenna diversity is used on either side of the communication link to create multiple spatial channels between the transmitter and the receiver. In short, large operating bandwidths and MIMO techniques are believed to be important enablers for future wireless communication systems of 5G and beyond.

BRIEF DESCRIPTION OF THE DRAWINGS

The present invention is illustrated by way of example and not limitation in the figures of the accompanying drawings in which like references indicate similar elements.

DETAILED DESCRIPTION

Various embodiments and aspects will be described with reference to details discussed below, and the accompanying drawings will illustrate the various embodiments. The following description and drawings are illustrative and are not to be construed as limiting. Numerous specific details are described to provide a thorough understanding of various embodiments. However, in certain instances, well-known or conventional details are not described in order to provide a concise discussion of embodiments.

Reference in the specification to "one embodiment" or "an embodiment" means that a particular feature, structure, or characteristic described in conjunction with the embodiment can be included in at least one embodiment. The appearances of the phrase "in one embodiment" and/or "in some embodiments" in various places in the specification do not necessarily all refer to the same embodiment. The processes depicted in the figures that follow are performed by processing logic that comprises hardware (e.g. circuitry, dedicated logic, etc.), software, or a combination of both. Although the processes are described below in terms of some sequential operations, it should be appreciated that some of the operations described may be performed in a different order. Moreover, some operations may be performed in parallel rather than sequentially. Throughout the specification, and in the claims, the term "connected" means a direct electrical connection between the things that are connected, without any intermediary devices. The term "coupled" means either a direct electrical connection between the things that are connected, or an indirect connection through one or more passive or active intermediary devices. The term "circuit" means one or more passive and/or active components that are arranged to cooperate with one another to provide a desired function. The term "signal" means at least one current signal, voltage signal or data/clock signal. The meaning of "a", "an", and "the" include plural references. The meaning of "in" includes "in" and "on". As used herein, the term "and/or" includes any and all combinations of one or more of the associated listed items.

As previously described, future directions of telecommunications support a move to mmWave frequencies. To serve prominent frequency bands for mmWave 5G communications globally, it is desirable that the device front end and the antenna supports a wide frequency range from 24 GHz to 43.5 GHz. The demands from the evolving wireless communication technology place stringent requirements on terminal device antenna design. The embodiments of the present disclosure address these demands by proposing a wideband polarization diverse antenna element suitable for mmWave MIMO antenna arrays. Therefore, the embodiments of the present disclosure may play a positive and vital role in boosting and promoting the development of the new generation of wireless communication systems where such antennas are in great demand.

Figure 1:
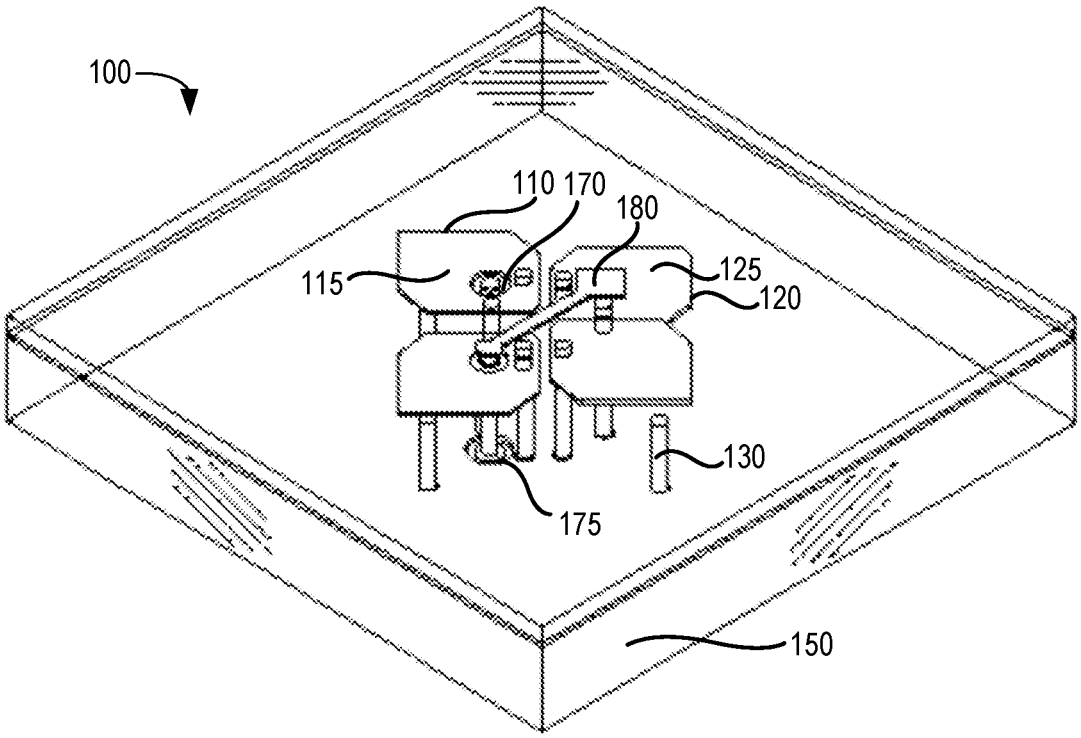
FIG. 1 is a schematic perspective view of an antenna element according to some embodiments of the present disclosure.
Figure 2:
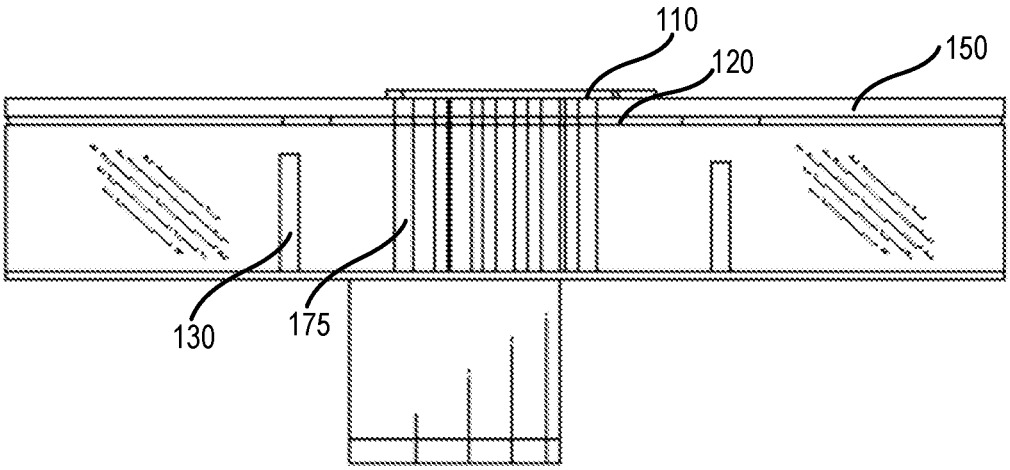
FIG. 2 is a side view of the antenna element of FIG. 1.

FIG. 1 is a schematic perspective view of an antenna element 100 according to some embodiments of the present disclosure. FIG. 2 is a side view of the antenna element 100 of FIG. 1. The antenna element 100 according to some embodiments of the present disclosure may be a wideband, polarization diverse antenna element 100.

Polarization diversity is achieved through two radiating arms 110, 120 arranged in orthogonal fashion on a suitable substrate material 150, which may be a multi-layer printed circuit board. Referring to FIGS. 1 and 2, a first radiating arm 110 may be arranged to have a longitudinal axis extending in a first direction. A second radiating arm 120 may be arranged to have a longitudinal axis extending in a second direction that crosses the first direction. In some embodiments, the longitudinal axis of the first radiating arm 110 may be arranged perpendicularly to the longitudinal axis of the second radiating arm 120.

The first radiating arm 110 may be arranged to be higher (e.g., vertically offset) from the second radiating arm 120. Stated another way, the first radiating arm 110 may be offset from the second radiating arm in a third direction that is orthogonal to the first and second directions. The offset may be a small fraction of the wavelength at the operating frequencies. In some embodiments, the first radiating arm 110 may be offset from the second radiating arm 120 in the third direction by 0.127 mm to 0.254 mm.

A signal may be applied to the first radiating arm 110 through a first port 170 and feed coupling (not shown). A signal may be applied to the second radiating arm 120 through a second port 175 and associated feed coupling 180. Orthogonal polarization is obtained by exciting the first and second radiating arms 110, 120 independently through the corresponding ports 170, 175. A differential feeding mechanism is adopted to excite the first and second radiating arms 110, 120 over a wide frequency bandwidth. In some embodiments, one of the first and second radiating arms 110, 120 may be provided with a signal that is vertically polarized while the other of the first and second radiating arms 110, 120 is provided with a signal that is horizontally polarized. The embodiments of the present invention are not limited to configurations in which the signal polarizations are horizontal and vertical. In some embodiments, one of the first and second radiating arms 110, 120 may be provided with a first signal that is polarized while the other of the first and second radiating arms 110, 120 is provided with a second signal that is polarized orthogonally to the first signal. In some embodiments, the first and second radiating arms 110, 120 may be configured to support transmission of first and second signals that range from 24 GHz to 43.5 GHz.

Each of the first and second radiating arms 110, 120 may include radiating elements. For example, the first radiating arm 110 may include opposing first radiating elements 115, and the second radiating arm 120 may include opposing second radiating elements 125. When viewed in plan, the first radiating elements 115 of the first radiating arm 110 may be arranged adjacent the second radiating elements 125 of the second radiating arm 120. The arrangement of the first and second radiating elements 115, 125 of the first and second radiating arms 110, 120 will be discussed further herein with respect to FIGS. 3A and 3B.

In some embodiments, the first and second radiating arms 110, 120 may be disposed in a substrate 150. In some embodiments, all or a part of the substrate 150 may be a portion of a printed circuit board (PCB). For example, in some embodiments, the first and second radiating arms 110, 120 may be arranged on different layers within the PCB. Thus, in some embodiments, the first radiating arm 110 may be separated from the second radiating arm 120 by at least a portion of the PCB.

In some embodiments, the radiating elements of the first and second radiating arms 110, 120 may be respectively disposed on and/or over parasitic posts 130. For example, the first radiating element 115 of the first radiating arm 110 may be disposed on and/or over a first parasitic post 130, and the second radiating element 125 of the second radiating arm may be disposed on and/or over a second parasitic post 130. The parasitic post 130 may have a longitudinal axis that extends vertically toward a respective one of the first or second radiating arms 110, 120. For example, as previously described, the first radiating arm 110 may be offset from the second radiating arm 120 in a third (e.g., vertical) direction. In some embodiments, the longitudinal axis of the parasitic post 130 may extend in the third direction and the parasitic post 130 may be offset from the respective one of the first or second radiating arms 110, 120. In some embodiments, the parasitic post 130 may have a cylinder shape, but the embodiments of the present disclosure are not limited to such a configuration. In some embodiments, the parasitic posts 130 are optional.

In some embodiments, the parasitic posts 130 may be formed of a conductive material, such as a conductive metal. Other conductive materials may be utilized without deviating from the scope of the present disclosure. In some embodiments, the parasitic posts 130 may be disposed within the substrate 150. For example, in some embodiments, portions of the substrate 150 (e.g., a portion of a PCB) may be between the parasitic post 130 and the first or second radiating arm 110, 120.

As will be described further herein, this particular element configuration of the antenna element 100 may help to improve impedance bandwidth of the antenna element 100 to cater to the frequency requirements of modern communication systems. The vertical parasitic posts 130 under the first and second radiating arms 110, 120, as can be seen in FIGS. 1 and 2, may act as parasitic radiators to enhance the element's radiation coverage at angles away from the boresight which may be desirable for wide-angle scanning arrays utilized in mobile communication applications. The parasitic posts 130 may further aid in radiation pattern symmetry of the antenna element 100. In addition, the simple configuration of the antenna element 100 may simplify its fabrication using conventional planar printed circuit board technology.

Figure 3A:
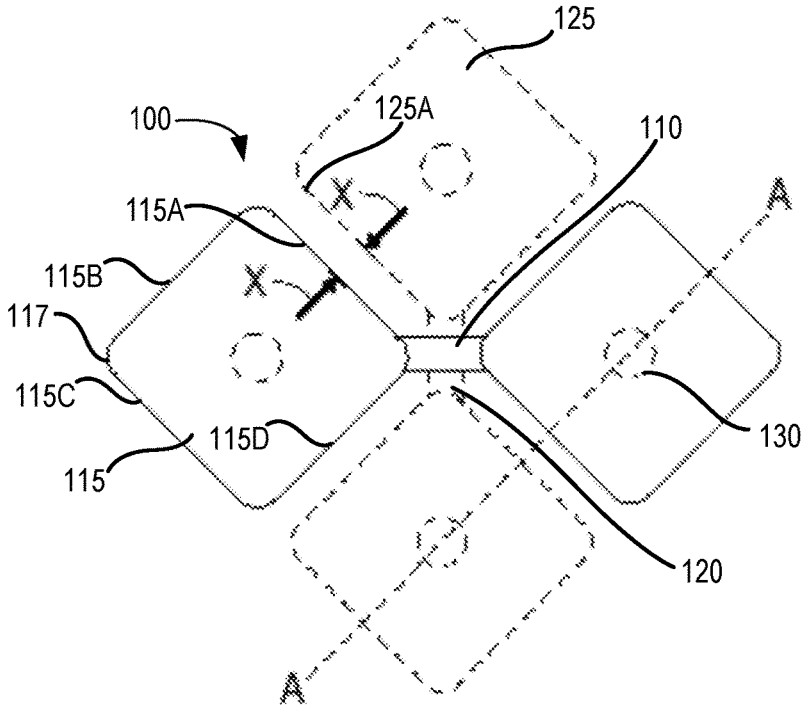
FIGS. 3A and 3B are schematic diagrams illustrating details of the antenna element of the present disclosure.
Figure 3B:
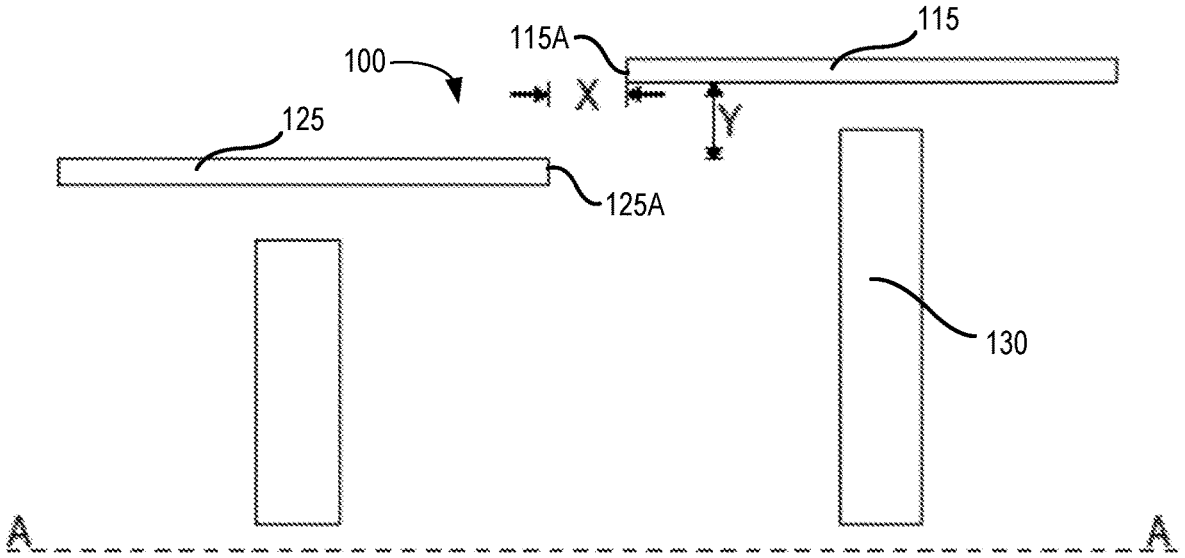

FIGS. 3A and 3B are schematic diagrams illustrating details of the antenna element 100 of the present disclosure. FIG. 3A is a plan view illustrating the details of the first and second radiating arms 110, 120, while FIG. 3B is a side view taken along line A-A of FIG. 3A. FIGS. 3A and 3B are intended to be illustrative of the structure of various elements of the antenna element 100 and are not intended to limit the embodiments of the present disclosure. The elements of FIGS. 3A and 3B are not intended to be representative of scale. A description of the elements of the FIGS. 3A and 3B that have been previously discussed will be omitted, or reduced, for brevity.

Referring to FIG. 3A, the first radiating arm 110 may have first radiating elements 115 on opposing ends of the first radiating arm 110. The second radiating arm 120 may have second radiating elements 125 on opposing ends of the second radiating arm 120. The first and second radiating elements 115, 125 may have various shapes. For example, the first and second radiating elements 115, 125 may have a square or diamond shape, when viewed in plan. In some embodiments, the first radiating elements 115 may have a different shape than the second radiating elements 125.

The first radiating element 115 may have a first outer edge 115A that is adjacent a second outer edge 125A of the second radiating element 125. The first outer edge 115A may be one of a plurality of outer edges of the first radiating element 115. For example, the first radiating element 115 of FIG. 3A is illustrated with four outer edges 115A, 115B, 115C, and 115D, though the embodiments of the present disclosure are not limited thereto. Adjacent ones of the outer edges 115A, 1151B, 115C, and 115D may be connected by corners 117. In some embodiments, the corners 117 may be a transition from one outer edge to another. The second outer edge 125A of the second radiating element 125 may similarly be one of a plurality of outer edges of the second radiating element 125, and duplicate description thereof will be omitted.

The first outer edge 115A of the first radiating element 115 may be a closest edge of the plurality of edges of the first radiating element 115 to the second radiating element 125. Similarly, the second outer edge 125A of the second radiating element 125 may be a closest edge of the second radiating element 125 to the first radiating element 115. As will be discussed further with respect to FIG. 3B, the first outer edge 115A of the first radiating element 115 may be diagonally offset from the second outer edge 125A of the second radiating element 125 due to the first radiating element 115 being offset (e.g., vertically) from the second radiating element 125.

The first outer edge 115A of the first radiating element 115 may extend substantially in parallel to the second outer edge 125A of the second radiating element 125 (e.g., when viewed in plan). As used herein, "substantially parallel" means that a distance between the two outer edges 115A, 125A does not vary by more than 10% along the length of the adjacent outer edges 115A, 125A. The parallel arrangement of the first and second outer edges 115A, 125A may assist in improving the performance of the antenna element 100. The two outer edges 115A, 125A may be horizontally offset by a small fraction of the wavelength at the operating frequencies. In some embodiments, a horizontal distance X between the first and second outer edges 115A, 125A may be between 0.127 mm and 0.3 mm.

Though the discussion with respect to FIG. 3A focused on the two adjacent outer edges 115A, 125A of the first and second radiating elements 115, 125, it will be understood that other outer edges of the first and second radiating elements 115, 125 may be adjacent to other radiating elements of the first and second radiating arms 110, 120. For example, referring to FIG. 3A, an additional outer edge 115D of the first radiating element 115 is adjacent the opposing second radiating element of the second radiating arm 120. In some embodiments, each of the first radiating elements 115 may have two outer edges that respectively extend substantially parallel to an adjacent outer edge of opposing ones of the second radiating elements 125. Similarly, each of the second radiating elements 125 may have two outer edges that respectively extend substantially parallel to an adjacent outer edge of opposing ones of the first radiating elements 115.

In some embodiments, each of the first and second radiating elements 115, 125 are disposed on parasitic posts 130. In some embodiments, when viewed in plan, the parasitic post 130 may be disposed near a center of the first and second radiating elements 115, 125. In some embodiments, at least a portion of the parasitic post 130 may be vertically overlapped by one of the first and second radiating elements 115, 125.

FIG. 3B illustrates a side view of the antenna element 100, including the first and second radiating elements 115, 125. As shown in FIG. 3B, the first radiating element 115 may be offset from the second radiating element 125 in both a first (e.g., a vertical) direction and a second (e.g., a horizontal) direction. For example, the first radiating element 115 may be offset from the second radiating element 125 in the first direction by a distance Y, which may be a small fraction of the wavelength at the operating frequencies. In some embodiments, the distance Y may range from 0.127 mm to 0.254 mm. The first radiating element 115 may also be offset from the second radiating element 125 in the second direction by a distance X, which may be a small fraction of the wavelength at the operating frequencies. In some embodiments. In some embodiments, the distance X may range from 0.127 mm and 0.3 mm. Because of the offsets in the first and second directions, the first and second outer edges 115A, 125A of the first and second radiating elements 115, 125 may be diagonally offset from one another.

In some embodiments, the parasitic post 130 may be offset in the first direction (e.g., the vertical direction) from a respective one of the first and second radiating elements 115, 125. This vertical offset may be a small fraction of the wavelength at the frequency of operation. In some embodiments, the radiating elements 115, 125 of the antenna element 100 may be disposed horizontally about a quarter wavelength of the operating frequency from the ground plane, and the height of the vertical parasitic posts 130 may be close to about a quarter wavelength at the frequency of operation. In some embodiments, the vertical offset between the parasitic post 130 in the first direction (e.g., the vertical direction) and a respective one of the first and second radiating elements 115, 125 may be about one percent of a free-space wavelength at the mid frequency of the wideband antenna. In some embodiments, this offset may be approximately 0.127 mm. In some embodiments, the offsets between various ones of the parasitic posts 130 and a first or second radiating element 115, 125 under which it is disposed in substantially the same (e.g., within 10% of one another). In some embodiments, the offsets between various ones of the parasitic posts 130 and a first or second radiating element 115, 125 under which it is disposed may differ from one another (e.g., by more than 10%). In some embodiments, the length in the first direction (e.g., the vertical direction) of a parasitic post 130 that is under one of the second radiating elements 125 is smaller than the length in the first direction (e.g., the vertical direction) of another parasitic post 130 that is under one of the first radiating elements 115, though the embodiments of the present disclosure are not limited thereto.

As previously described, in some embodiments, one or more of the parasitic posts 130 may be omitted. For example, in some embodiments a parasitic post 130 may be under one of the first radiating elements 115 but not under other ones of the first radiating elements 115. Similarly, in some embodiments a parasitic post 130 may be under one of the second radiating elements 125 but not under other ones of the second radiating elements 125. In some embodiments, a parasitic post 130 may be under one or more of the first radiating elements 115 but not under the second radiating elements 125. In some embodiments, the parasitic posts 130 may be omitted altogether.

Figure 4:
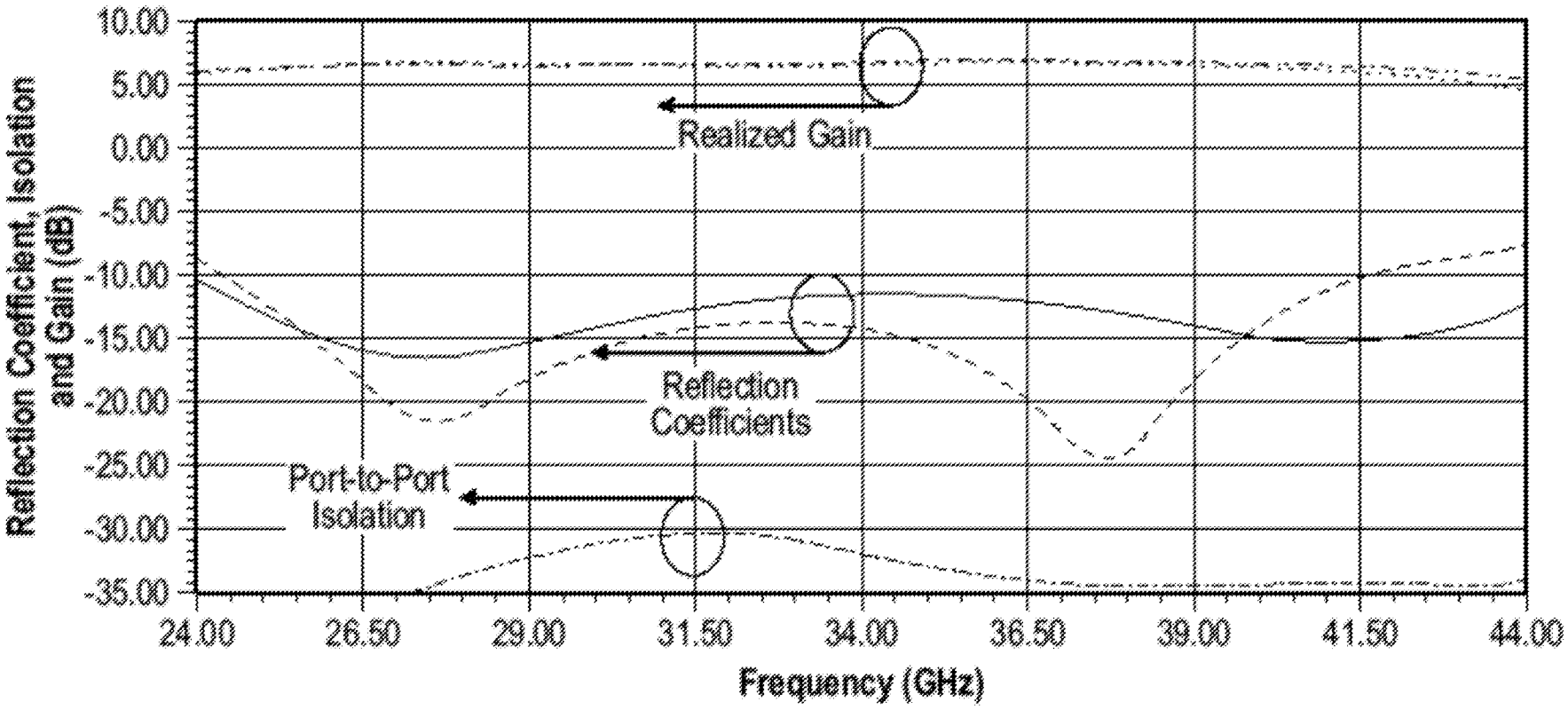
FIG. 4 is a graph illustrating an electrical performance of an antenna element according to some embodiments of the present disclosure.

FIG. 4 is a graph illustrating an electrical performance of an antenna element according to some embodiments of the present disclosure. FIG. 4 shows electrical performance of an antenna element according to some embodiments of the present disclosure in terms of impedance match (or, return loss), port-to-port isolation, and realized gain over the frequency of interest (e.g., 24 GHz to 43.5 GHz). It can be seen that the antenna element is able to cover the wide frequency bandwidth required for mmWave 5G with a return loss of better than 10 dB over most part of the band. The isolation between the two ports stays better than 30 dB at all frequencies. The antenna element shows stable, broadside realized gain over the entire operating band with variation less than a dB in either polarization.

Figure 5:
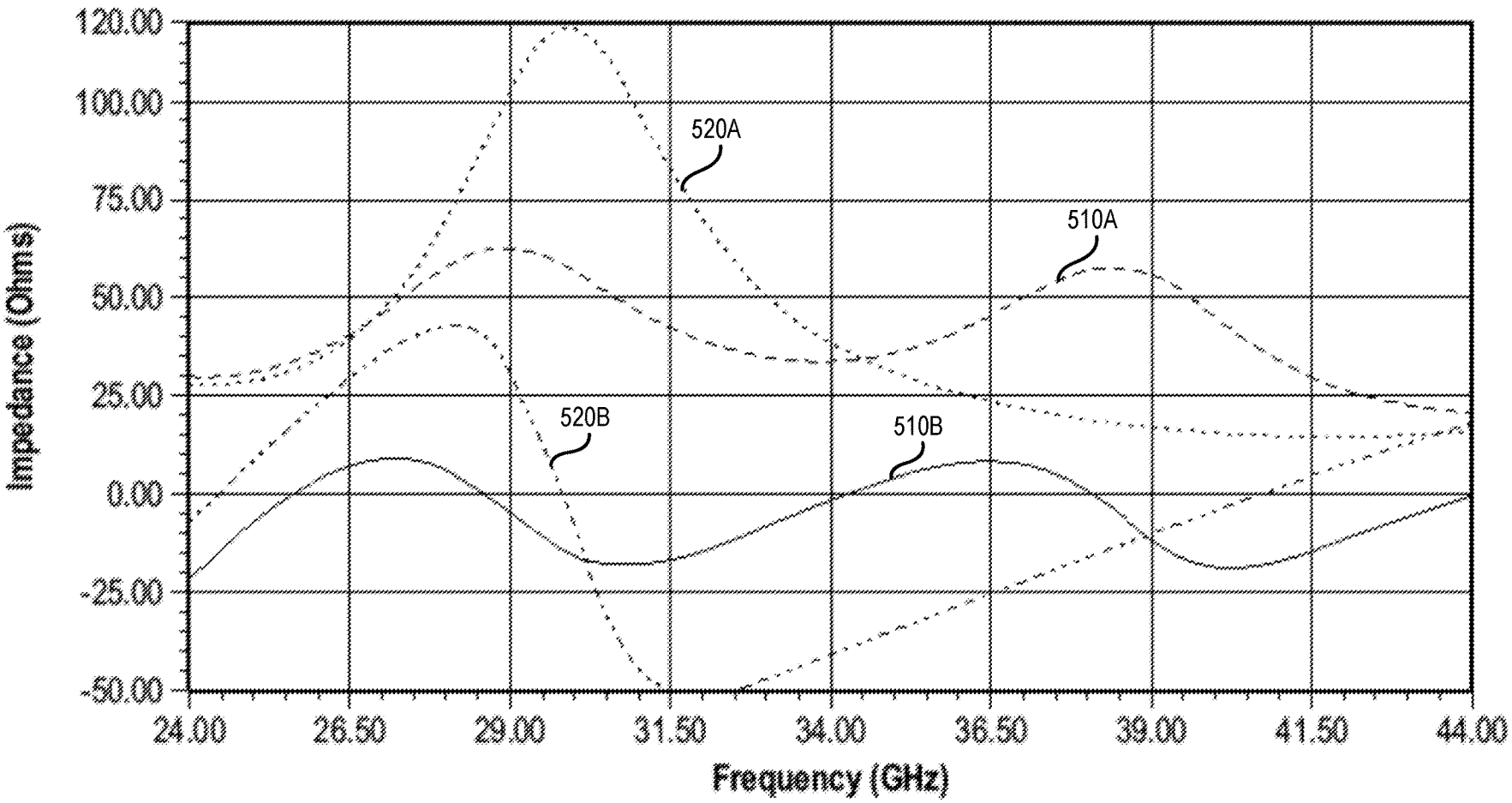
FIG. 5 is a graph of impedance with respect to frequency for an antenna element according to some embodiments of the present disclosure.
Figure 6:
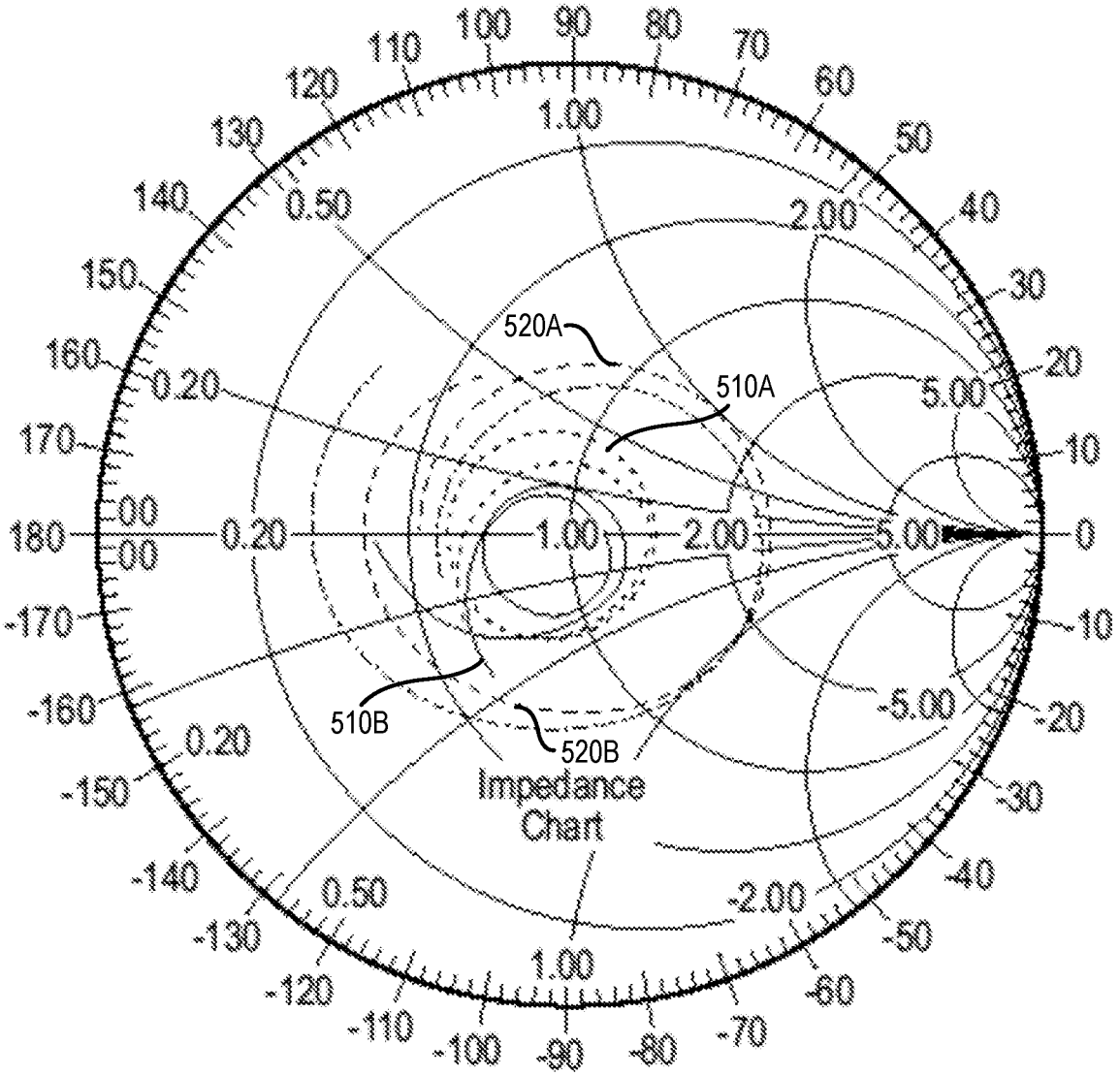
FIG. 6 is a Smith chart illustrating impedance for the antenna element according to some embodiments of the present disclosure.

FIG. 5 is a graph of impedance with respect to frequency for an antenna element according to some embodiments of the present disclosure. FIG. 6 is a Smith chart illustrating impedance for the antenna element according to some embodiments of the present disclosure.

FIG. 5 shows the real parts 510A and imaginary parts 510B of the impedance looking into a port (any port) of the proposed antenna element according to some embodiments of the present disclosure compared to the real parts 520A and imaginary parts 520B of a related antenna element when only a single radiating arm is present as for a conventional dipole-like element. It can be seen for the antenna element according to some embodiments of the present disclosure that the variation in the real 510A and imaginary 510B parts of the input impedance over the frequency becomes much less compared to the single arm structure 520A, 520B.

The impedance chart of FIG. 6 further illustrates this effect where a much tighter impedance curve means lower impedance variation versus frequency for the antenna element according to some embodiments of the present disclosure (lines 510A and 510B) compared to the single arm structure (lines 520A and 520B). Moreover, the configuration according to some embodiments of the present disclosure may provide an additional resonance at higher side of the frequency band (see e.g., FIG. 5) which may further facilitate wideband impedance matching of the antenna element to the system. Therefore, the combination of having an additional resonance as well as reducing the impedance variation over frequency may enable the antenna element according to some embodiments of the present disclosure to deliver a wideband response suitable to cover the mmWave 5G bands.

Figure 7:
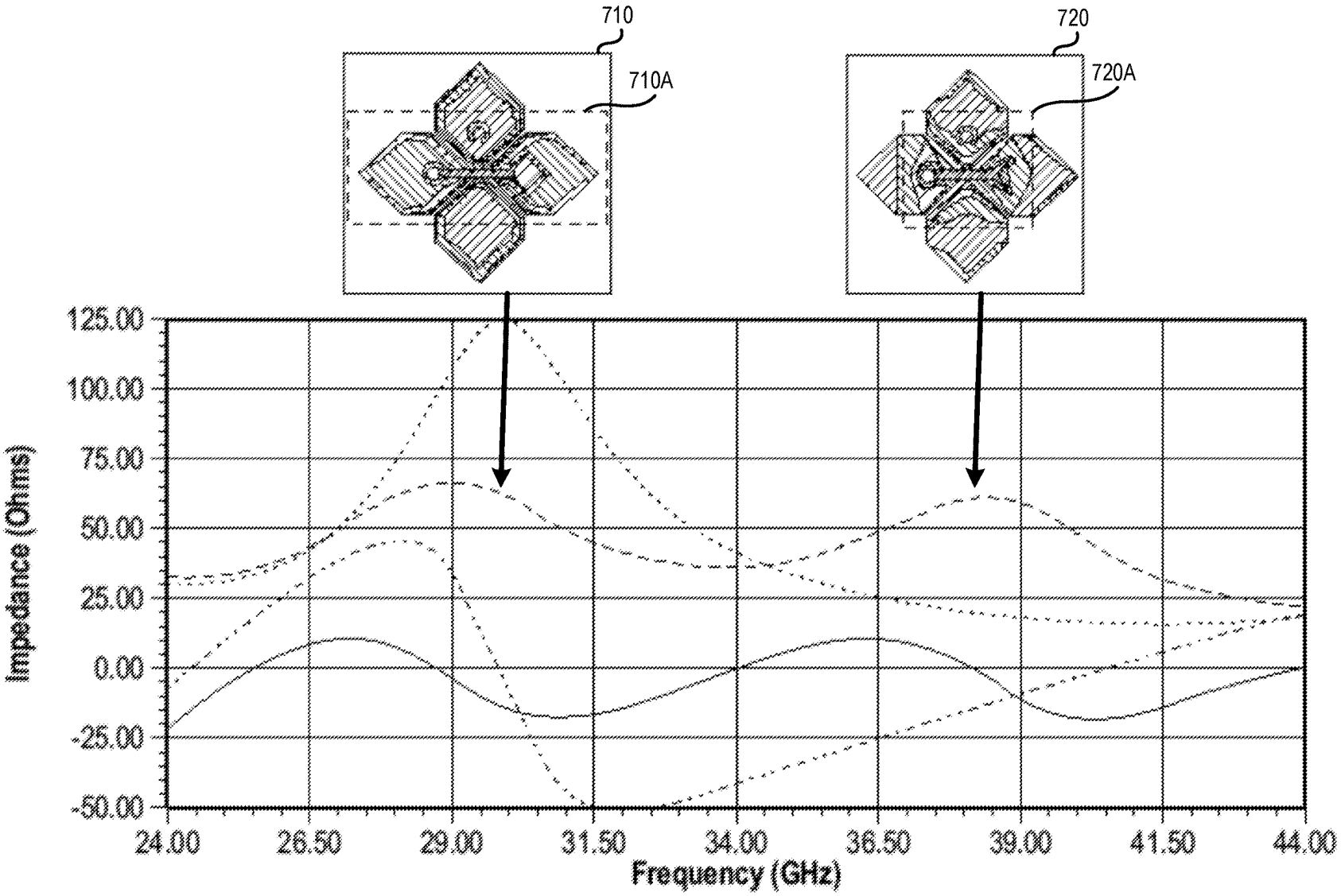
FIG. 7 illustrates an example behavior of surface currents for an antenna element according to some embodiments of the present disclosure.

FIG. 7 illustrates an example behavior of surface currents for an antenna element according to some embodiments of the present disclosure. More specifically, FIG. 7 illustrates the surface currents for an antenna element according to some embodiments of the present disclosure at two different frequencies at the lower and higher sides of the frequency band. In FIG. 7, example 710 is illustrates surface currents when operating between 20 GHz and 31.5 GHz while example 720 illustrates surface currents when operating between 36.5 GHz and 39 GHz.

Referring to FIG. 7, it can be seen that at lower frequency most of the current is flowing on the arm with direct excitation (the horizontal arm in this case), as shown by box 710A, whereas at the higher frequency significant surface currents can be observed on both arms of the element, as shown by box 720A. So, at higher frequencies the other arm (the vertical arm in this case) may be excited parasitically, and may act like an open sleeve structure for the dipole-like arm that is excited. It is believed that this mechanism may give the additional resonance described herein with respect to FIGS. 5 and 6. The presence of the open sleeve effect may help moderate the impedance variation with frequency, thus further facilitating a wideband impedance match.

Figure 8:
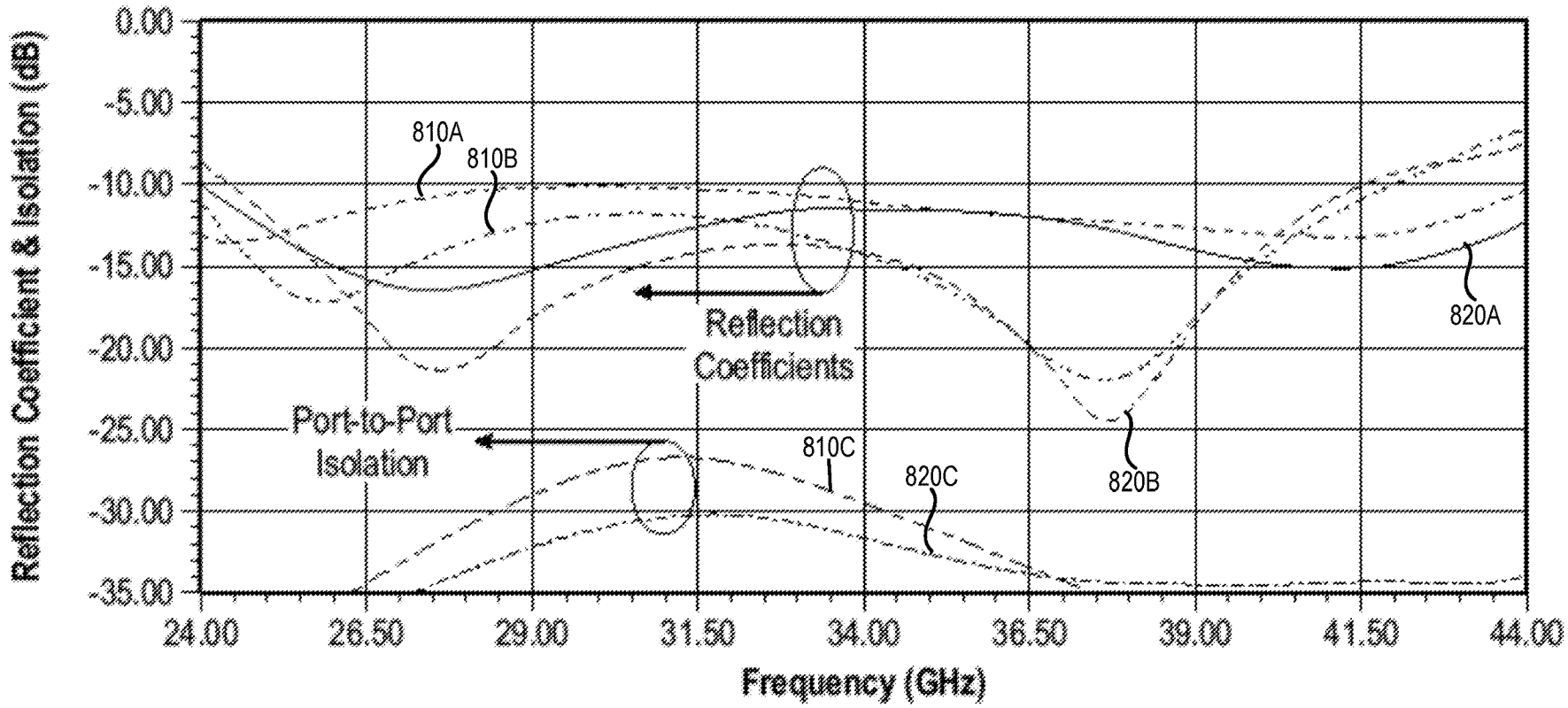
FIG. 8 illustrates a comparison of an antenna element according to some embodiments of the present disclosure that utilizes a parasitic post as compared to one that does not.

FIG. 8 illustrates a comparison of an antenna element according to some embodiments of the present disclosure that utilizes a parasitic post as compared to one that does not. In FIG. 8, lines 810A, 810B, and 810C illustrate the performance of an antenna element utilizing parasitic posts, while lines 820A, 820B, and 820C illustrate the performance of an antenna element omitting the parasitic posts.

Figure 9A:
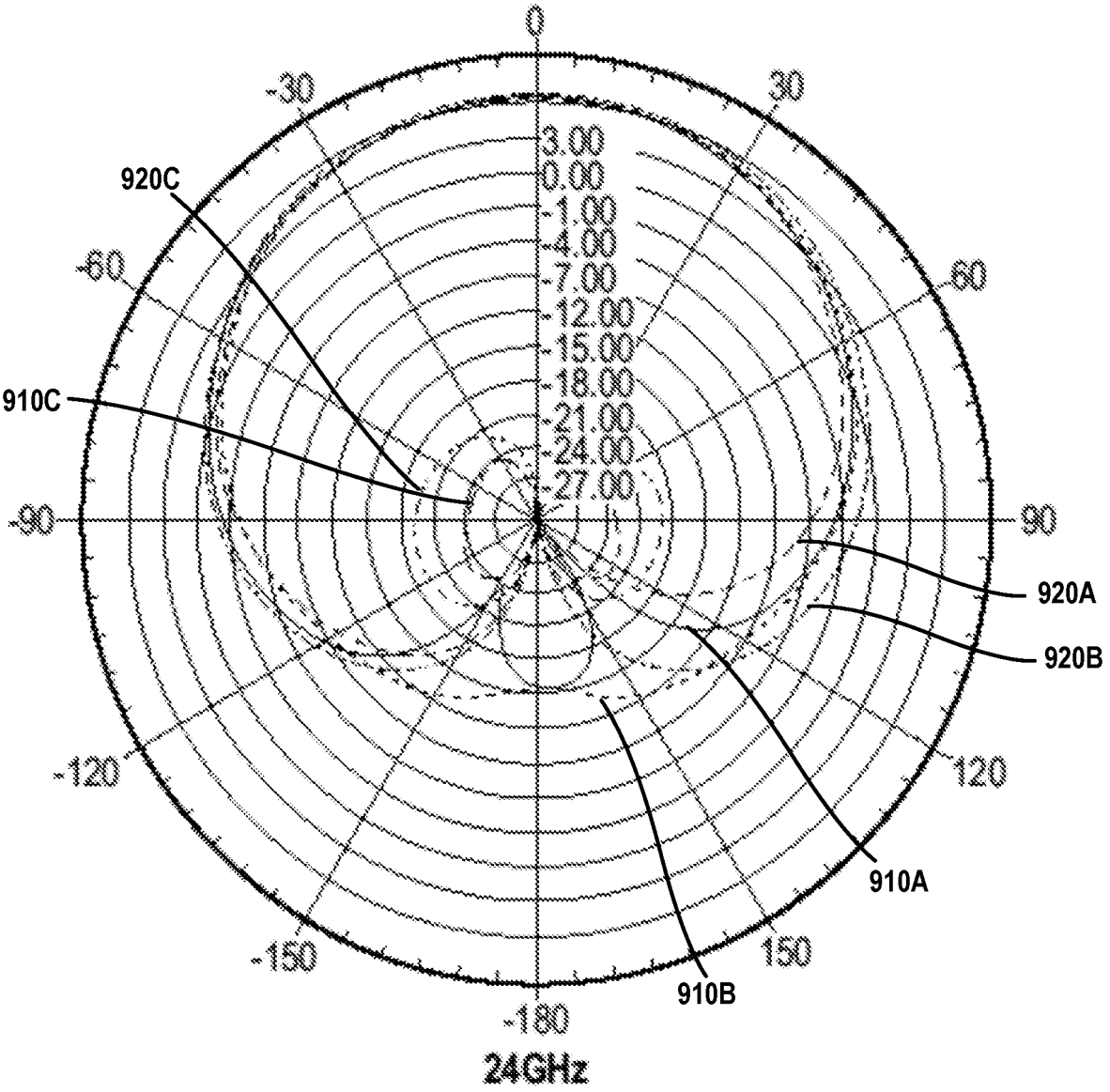
FIGS. 9A and 9B illustrate example radiation patterns for the antenna elements of FIG. 8 at an operating frequency of 24 GHz and 43 GHz, respectively.
Figure 9B:
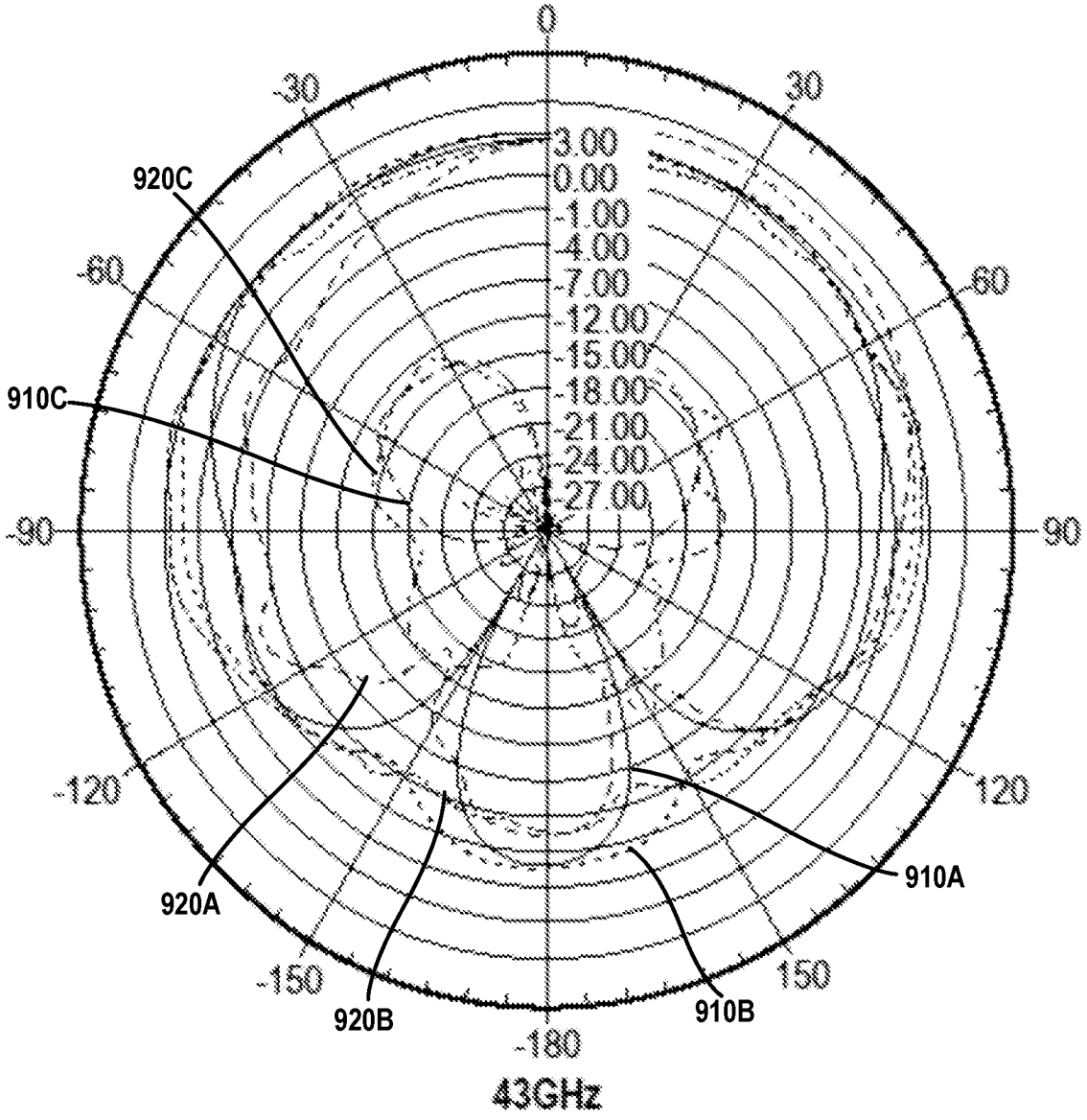

FIGS. 9A and 9B illustrate example radiation patterns for the antenna elements of FIG. 8 at an operating frequency of 24 GHz and 43 GHz, respectively. In FIGS. 9A and 9B, the lines 910A, 910B, 910C illustrate the performance of an antenna element utilizing parasitic posts, while lines 920A, 920B, and 920C illustrate the performance of an antenna element omitting the parasitic posts.

One of the issues with a dipole like element such as that described herein is that the beamwidth of the radiation pattern in the E-plane (i.e., the plane along the direction of surface currents or the electric fields) decreases as frequency increases. In other words, as the element's electrical length (length in terms of wavelength) increases, a squeeze in radiation pattern is observed in the E-plane. This can be seen for the curve 920A in FIG. 9B. To improve the radiation pattern properties at the higher side of the frequency band (where the electrical length is comparatively larger) some embodiments of the present disclosure utilize parasitic posts 130 (e.g., vertical metallic vias). These parasitic posts 130, when designed properly for the height and positioned suitably near the radiating arms 110, 120 of the antenna element 100 (see, e.g., FIGS. 1, 2, 3A, 3B) may act as parasitic monopoles and provide radiation away from boresight. The combination of the radiation from the radiating arms 110, 120 of the antenna element 100 and the parasitic posts 130 result in a wide-angular beam coverage for the antenna element 100 according to some embodiments of the present disclosure. Furthermore, as can be concluded from FIG. 8, the proposed parasitic posts 130 do not affect the impedance bandwidth or isolation characteristics (lines 810A, 810B, 810C) of the structure significantly. FIGS. 9A and 9B illustrate that at the higher frequency a significant improvement in E-plane beamwidth (line 910A) and pattern symmetry is obtained from using the antenna element according to some embodiments of the present disclosure.

Figure 10B:
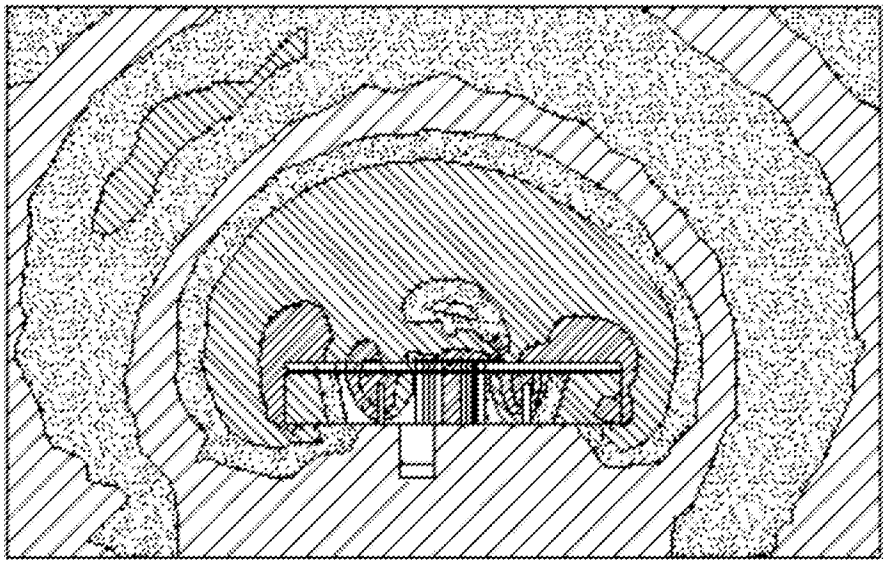
FIGS. 10A and 10B illustrate a comparison of an electric field plot of an antenna element according to some embodiments of the present disclosure that utilizes a parasitic post as compared to one that does not.
Figure 10A:
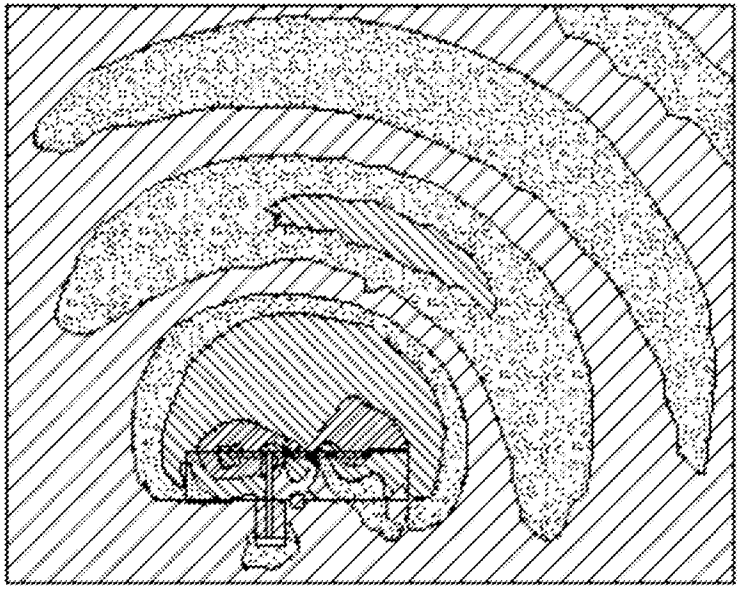

FIGS. 10A and 10B illustrate a comparison of an electric field plot of an antenna element according to some embodiments of the present disclosure that utilizes a parasitic post as compared to one that does not. In FIG. 10B, in which a parasitic post 130 is used, it can be seen that a more symmetric radiation is obtained by introducing the parasitic post 130 into the structure.

Figure 11:
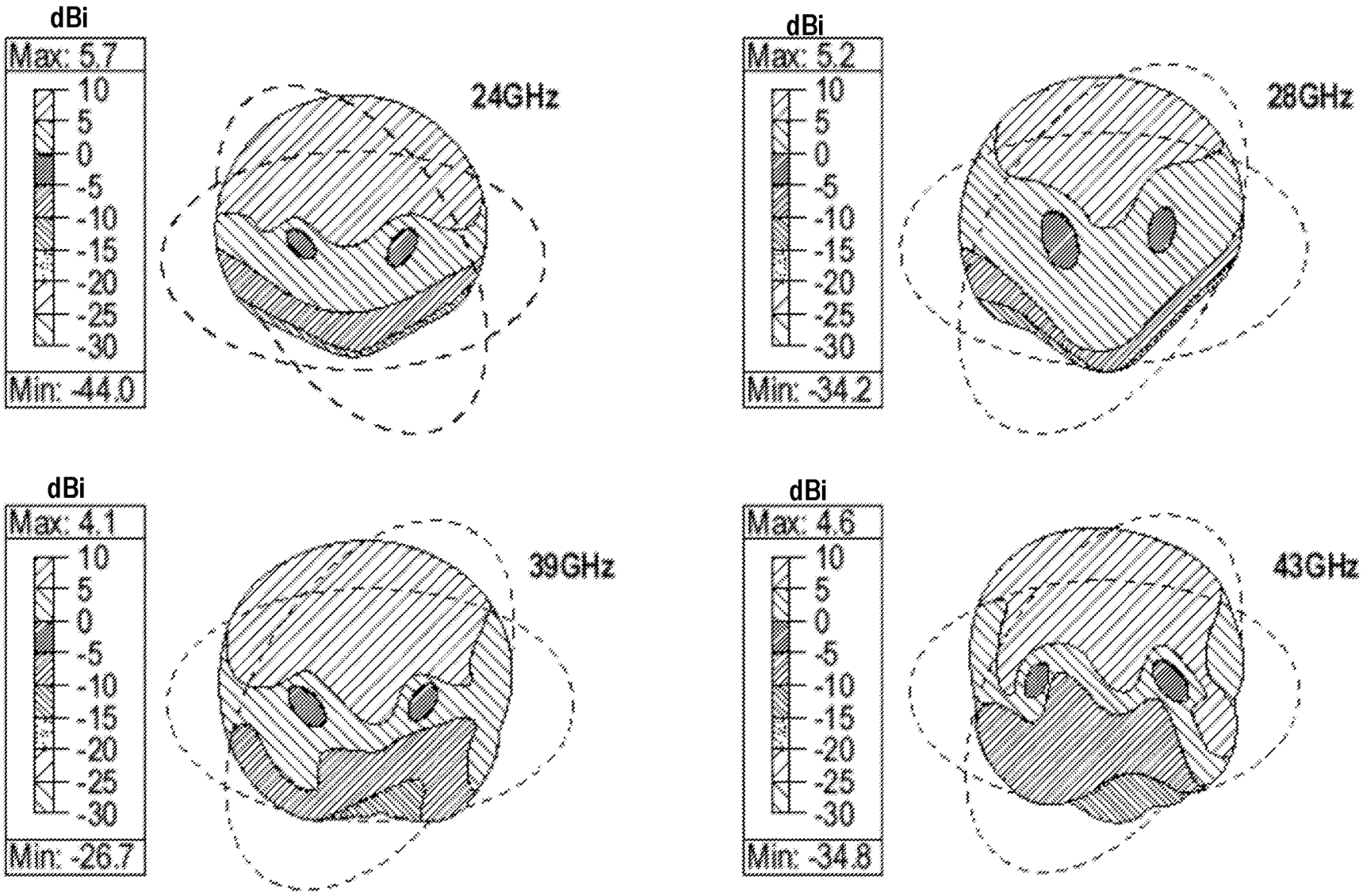
FIG. 11 illustrates the 3D radiation patterns for an antenna element according to some embodiments of the present disclosure with parasitic posts for one of the polarization signals.

FIG. 11 illustrates the 3D radiation patterns for an antenna element 100 according to some embodiments of the present disclosure with the parasitic posts 130 for one of the polarization signals. FIG. 11 illustrates radiation patterns for operations of one of the radiating arms at 24 GHz, 28 GHz, 39 GHz, and 43 GHz. As can be seen in FIG. 11, good pattern properties with a stable, broadside pattern, and wide angular radiation characteristics can be observed over the frequency band of interest.

Though the parasitic posts 130 provide additional improvements to the antenna element 100, some embodiments of the antenna element 100 may nonetheless show improved performance over conventional devices while omitting the parasitic posts 130. Thus, embodiments of the present disclosure may still provide an improved antenna element 100 despite the absence of the parasitic posts 130.

Figure 12:
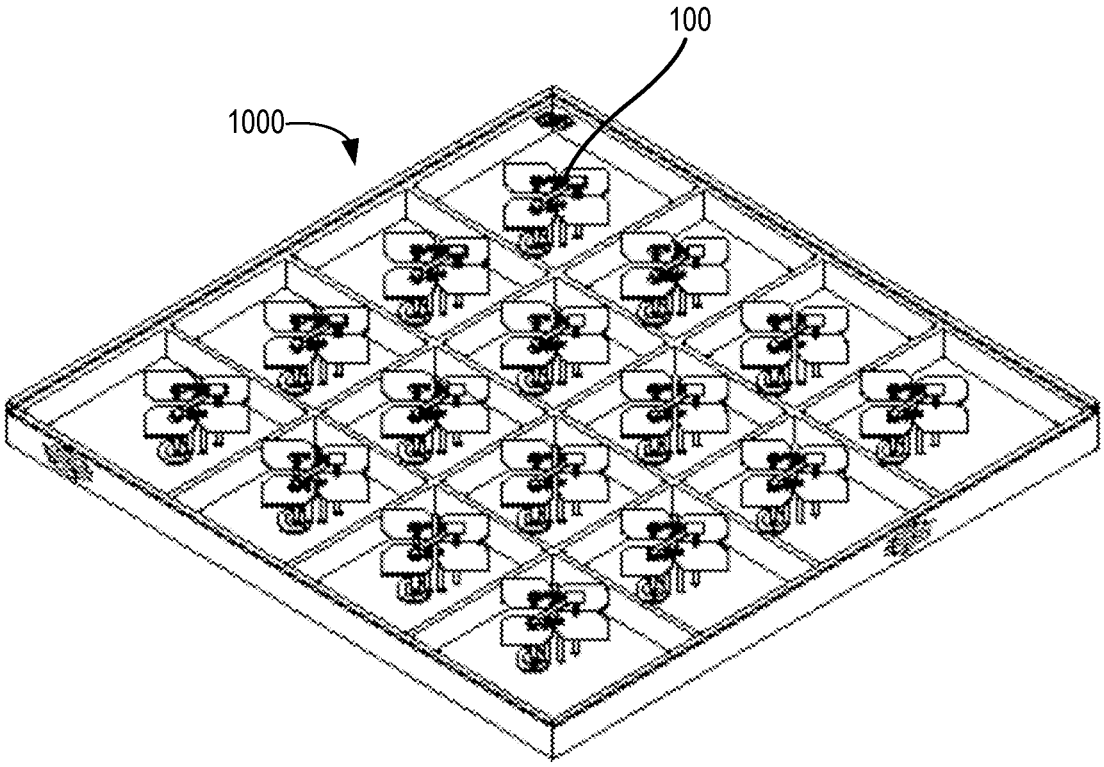
FIG. 12 is a schematic perspective view of an example antenna array according to some embodiments of the present disclosure.
Figure 13:
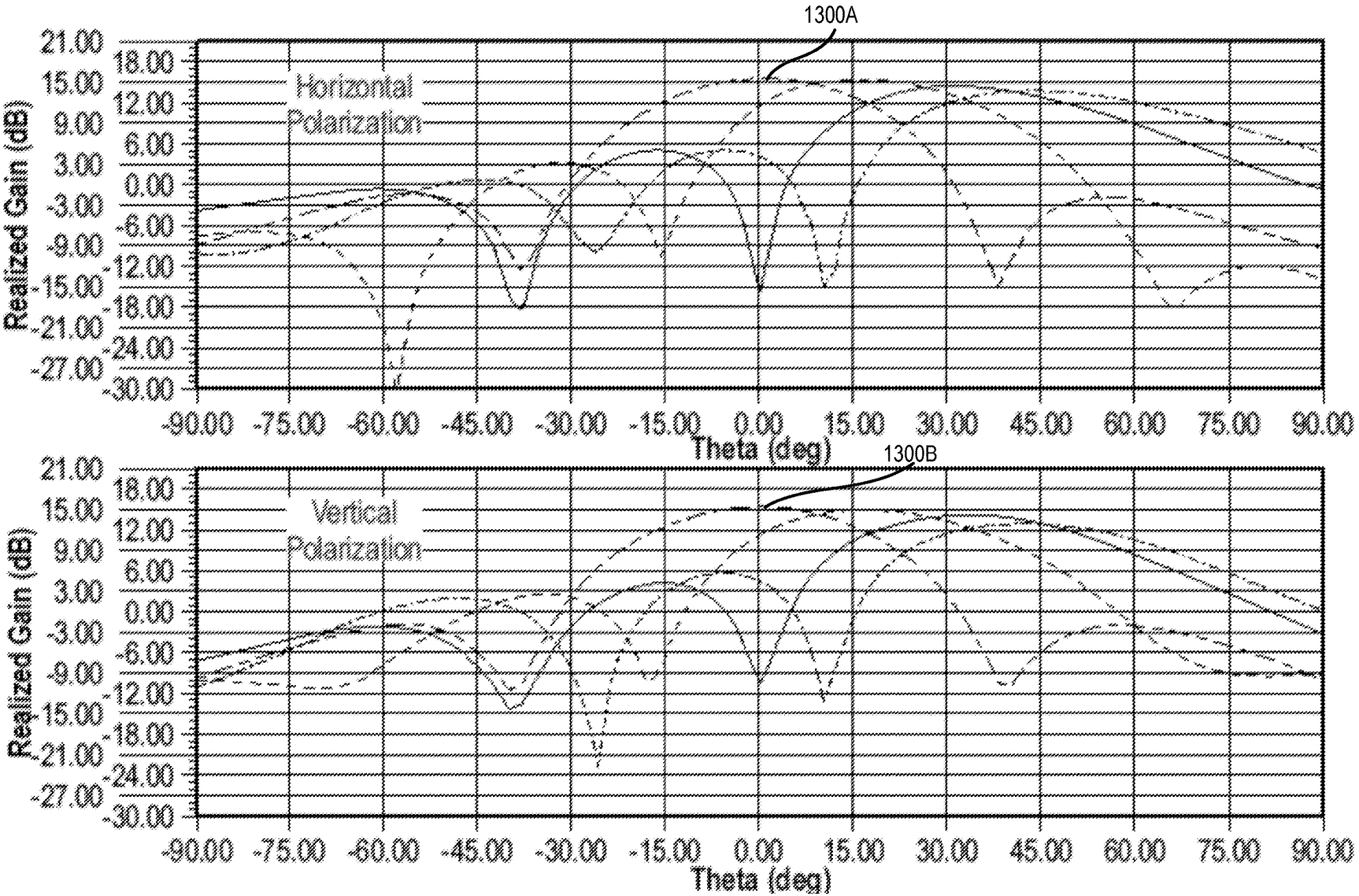
FIG. 13 is a graph illustrating the performance of the antenna array of FIG. 12.

FIG. 12 is a schematic perspective view of an example antenna array 1000 according to some embodiments of the present disclosure. FIG. 13 is a graph illustrating the performance of the antenna array 1000 of FIG. 12.

In FIG. 12, the antenna array 1000 is of a 16 element array of the antenna element 100 using wideband dual-polarized elements according to some embodiments described herein. For FIG. 13, the first and second radiating arms 110, 120 were provided with a horizontal and vertical polarized signal, respectively. FIG. 13 illustrates the performance of the wide-angle scanning for the antenna array 1000 where equally good beam scanning performance can be observed in either polarization. In FIG. 13, lines 1300A and 1300B are scans taken in the broadside direction. The 16 element array of FIG. 12 is merely an example, and antenna arrays 1000 of other sizes are possible without deviating from the scope of the present disclosure. The antenna element 100 according to some embodiments of the present disclosure is scalable to antenna arrays 1000 of any size requiring large frequency bandwidth, wide angle coverage, and polarization diversity.

Figure 14:
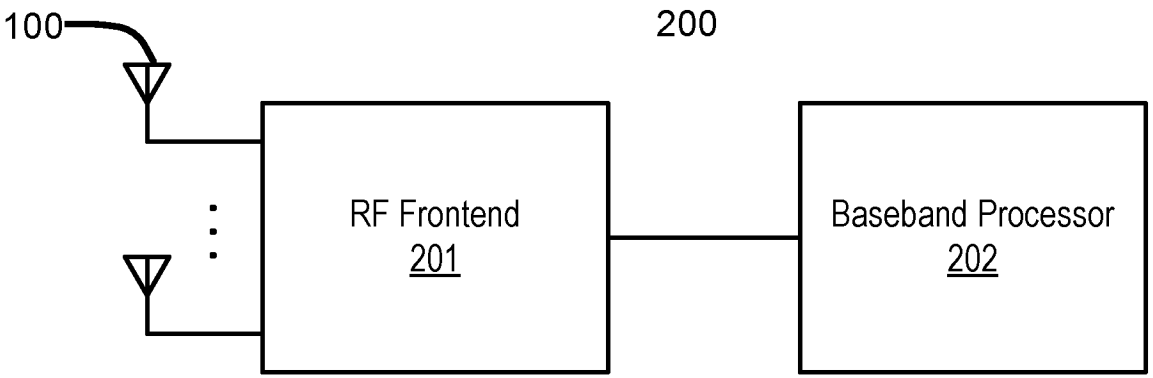
FIG. 14 is a block diagram of an example of a wireless communication device according to some embodiments of the present disclosure.

FIG. 14 is a block diagram of an example of a wireless communication device 200 according to some embodiments of the present disclosure. Referring to FIG. 14, wireless communication device 200, also simply referred to as a wireless device, includes, amongst others, an RF frontend module 201 and a baseband processor 202. Wireless device 200 can be any kind of wireless communication devices such as, for example, mobile phones, laptops, tablets, network appliance devices (e.g., Internet of thing or IOT appliance devices), etc.

In a radio receiver circuit, the RF frontend 201 is a generic term for all the circuitry between the antenna up to and including the mixer stage. It consists of all the components in the receiver that process the signal at the original incoming radio frequency, before it is converted to a lower frequency, e.g., IF. In microwave and satellite receivers it is often called the low-noise block (LNB) or low-noise downconverter (LND) and is often located at the antenna, so that the signal from the antenna can be transferred to the rest of the receiver at the more easily handled intermediate frequency. A baseband processor 202 is a device (a chip or part of a chip) in a network interface that manages all the baseband processing functions to process baseband signals.

In a radio transmitter circuit, the RF frontend 201 is a generic term for all the circuitry between the mixer stage up to and including the antenna. It consists of all the components in the transmitter that processes the signal at the more easily handled intermediate frequency, IF, before it is converted to a radio frequency, e.g., RF, for transmission. In microwave and satellite transmitters it is often called the block upconverter (BUC), which makes up the "transmit" side of the system, and is often used in conjunction with an LNB, which makes up the "receive" side of the system.

In some embodiments, RF frontend module 201 includes one or more RF transceivers, where each of the RF transceivers transmits and receives RF signals within a particular frequency band (e.g., a particular range of frequencies such as non-overlapped frequency ranges) via one of a number of RF antennas. One or more of the RF antennas may include the antenna element 100 as described herein.

Figure 15:
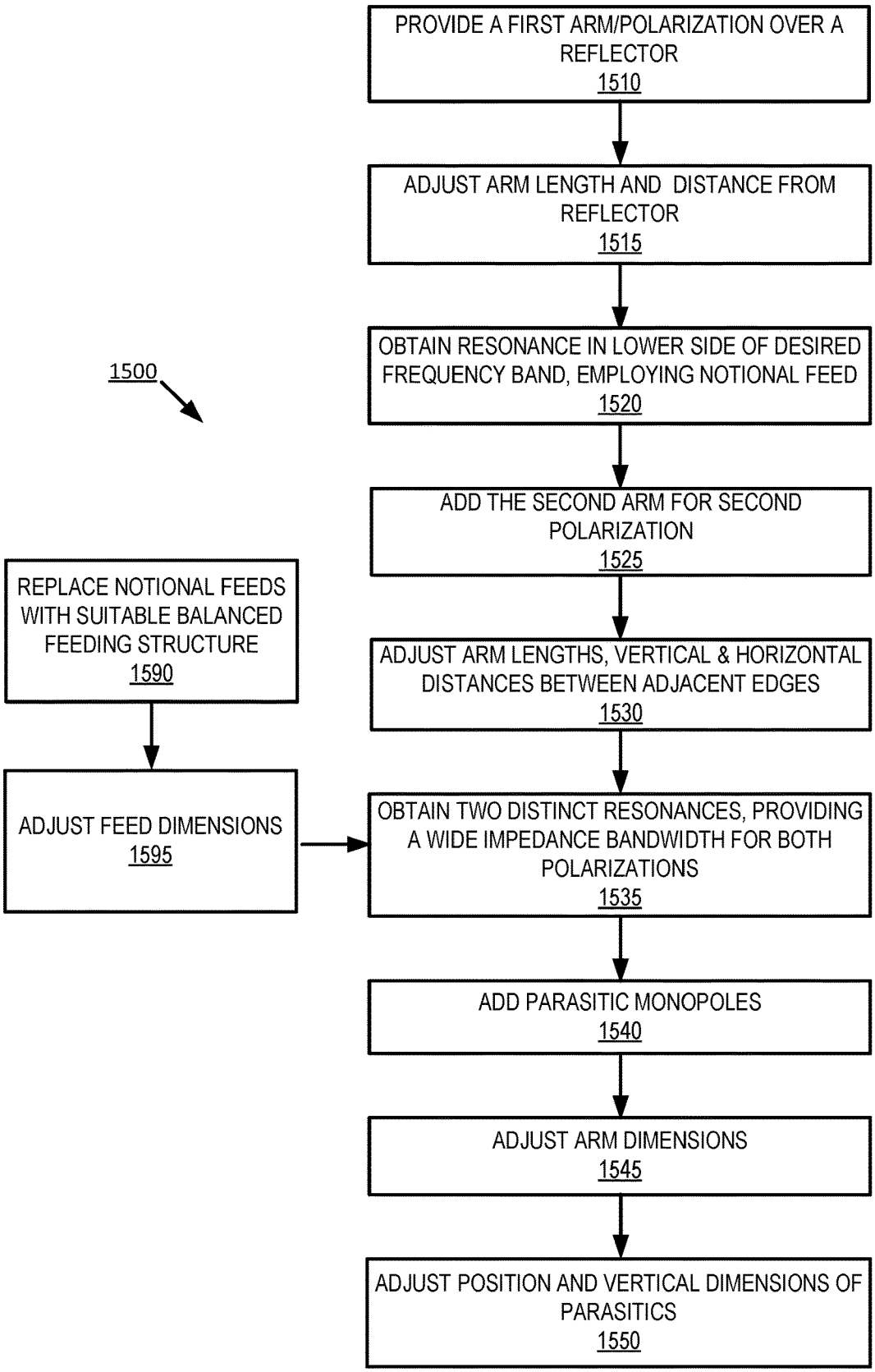
FIG. 15 is a flow diagram of a method of designing an antenna element, in accordance with one or more aspects of the disclosure.

FIG. 15 is a flow diagram of a method 1500 of designing an antenna element 100, in accordance with one or more aspects of the disclosure. In some embodiments, method 1500 may be performed by processing logic that may comprise hardware (e.g., circuitry, dedicated logic, programmable logic, a processor, a processing device, a central processing unit (CPU), a system-on-chip (SoC), etc.), software (e.g., instructions running/executing on a processing device), firmware (e.g., microcode), or a combination thereof. In some embodiments, at least a portion of method 1500 may be performed by a computing device executing program instructions configured to design antenna elements and/or simulate antenna performance.

With reference to FIG. 15, method 1500 illustrates example functions used by various embodiments. Although specific function blocks ("blocks") are disclosed in method 1500, such blocks are examples. That is, embodiments are well suited to performing various other blocks or variations of the blocks recited in method 1500. It is appreciated that the blocks in method 1500 may be performed in an order different than presented, and that not all of the blocks in method 1500 may be performed.

Method 1500 begins at block 1510, a first radiating arm may be provided. The first radiating arm may be similar to one of the first and second radiating arms 110, 120 discussed herein. In some embodiments, the first radiating arm may be provided over a reflector. The reflector may be similar to the suitable substrate material 150 discussed herein. In some embodiments, the first radiating arm may be configured for a signal polarized in a particular direction.

At block 1515, the configuration of the first radiating arm may be adjusted. For example, a length of the arm length and/or a distance of the first radiating arm from the reflector.

The adjustments of block 1515 may be continued until block 1520, when a resonance is obtained in a lower side of the desired operating frequency band. Examples of the types of resonance that may be obtained are illustrated, for example, in curves 520A and 520B in FIG. 5. In some embodiments, a notional feed may be utilized to obtain the resonance.

At block 1525, a second radiating arm may be provided. The second radiating arm may be similar to one of the first and second radiating arms 110, 120 discussed herein. The second radiating arm may be arranged orthogonal to the first radiating arm in a manner similar to that disclosed herein with respect to the first and second radiating arms 110, 120. In some embodiments, the second radiating arm may be configured for a signal polarized in an orthogonal direction from that of the first radiating arm.

At block 1530, the configuration of the second radiating arm may be adjusted. For example, a length of the arm length of the second radiating arm may be adjusted. In addition, vertical and horizontal offsets between adjacent edges of the first radiating arm and the second radiating arm may be adjusted. The adjacent edges of the first and second radiating arms may be similar to the first and second edges 115A, 125A discussed herein.

The adjustments of block 1530 may be continued until block 1535, when two distinct resonances are obtained. Examples of the types of resonance that may be obtained are illustrated, for example, in curves 510A and 510B in FIG. 5. In some embodiments, a notional feed may be utilized to obtain the two resonances. In some embodiments, as illustrated at block 1590, the notional feed may be replaced with a suitable balanced feeding structure. Examples of the balanced feeding structure are illustrated, for example, by the second port 175 and feed coupling 180 described with respect to FIG. 1. In some embodiments, the feed dimensions of the balanced feeding structure may be adjusted in block 1595 as part of, or prior to, obtaining the two distinct resonances in block 1535.

At block 1540, parasitic monopoles may be added. The parasitic monopoles may be similar to the parasitic posts 130 discussed herein. The parasitic monopoles may be arranged under the first and second radiating arms in a manner similar to that disclosed herein with respect the parasitic posts 130 in relation to the first and second radiating arms 110, 120.

At block 1545, the arm dimensions of the first and second radiating arms may be adjusted again. In some embodiments, the adjustments to the first and second radiating arms will be made based on the measured and/or simulated performance of the antenna element. In some embodiments, the adjustments may be made in light of a particular range of operating frequency at which the antenna element is intended to operate.

At block 1550, the position and vertical dimensions of the parasitic monopoles may be adjusted. In some embodiments, the adjustments to the parasitic monopoles will be made based on the measured and/or simulated performance of the antenna element. In some embodiments, the adjustments may be made in light of a particular range of operating frequency at which the antenna element is intended to operate.

The result of the method illustrated and described with respect to FIG. 15 is a wideband wide-beamwidth polarization diverse antenna in accordance with some embodiments of the present disclosure. Though FIG. 15 illustrates one method by which such an antenna element according to embodiments of the present disclosure may be generated, but it will be understood that other and/or additional operations may be used. As such, the method of FIG. 15 is merely an example and is not intended to limit the embodiments of the present disclosure.

Embodiments of the present invention are not limited to any particular application. It can be used in various wireless applications and at various frequencies and with different multiple access methods, advantageously at radio frequencies such as the fifth generation mobile communications standard frequencies.

In the foregoing specification, specific exemplary embodiments have been described. It will be evident that various modifications may be made to those embodiments without departing from the broader spirit and scope set forth in the following claims. The specification and drawings are, accordingly, to be regarded in an illustrative sense rather than a restrictive sense.

What is claimed is:

1. An antenna comprising:

a first radiating arm comprising a first radiating element having a first outer edge;

a second radiating arm that is arranged orthogonally on the first radiating arm and separated from the first radiating arm in a first direction, the second radiating arm comprising a second radiating element having a second outer edge; and a conductive parasitic post, wherein the first outer edge of the first radiating element extends substantially parallel to the second outer edge of the second radiating element, and wherein the first radiating element is on the conductive parasitic post.

2. The antenna of claim 1, wherein the conductive parasitic post comprises a conductive metal.

3. The antenna of claim 1, wherein the conductive parasitic post is a first conductive parasitic post, wherein the antenna further comprises a second conductive parasitic post, and wherein the second radiating element is on the second conductive parasitic post.

4. The antenna of claim 1, wherein the first radiating arm is configured to transmit a first signal, and wherein the second radiating arm is configured to transmit a second signal that is orthogonally polarized with respect to the first signal.

5. The antenna of claim 4, wherein the first signal is horizontally polarized, and wherein the second signal is vertically polarized.

6. An antenna comprising:

a first radiating arm comprising a first radiating element having a first outer edge; and a second radiating arm that is arranged orthogonally on the first radiating arm and separated from the first radiating arm in a first direction, the second radiating arm comprising a second radiating element having a second outer edge, wherein the first outer edge of the first radiating element extends substantially parallel to the second outer edge of the second radiating element, and wherein the first and second radiating arms are configured to support transmission and/or reception from 24 GHz to 43.5 GHz.

7. The antenna of claim 1, further comprising a printed circuit board (PCB), wherein at least a portion of the PCB is between the first radiating arm and the second radiating arm in the first direction.

8. The antenna of claim 1, wherein the first radiating arm comprises a third radiating element opposite the first radiating arm from the first radiating element, the third radiating element comprising a third outer edge, wherein the second radiating arm comprises a fourth radiating element opposite the second radiating arm from the second radiating element, the fourth radiating element comprising a fourth outer edge, and wherein the third outer edge of the first radiating element extends substantially parallel to the fourth outer edge of the second radiating element.

9. An antenna apparatus comprising:

an antenna comprising:

a first radiating arm comprising a first radiating element comprising a first outer edge; and a second radiating arm that is orthogonal to the first radiating arm and vertically offset from the first radiating arm, the second radiating arm comprising a second radiating element having a second outer edge, wherein at least a first portion of the first outer edge of the first radiating element and a second portion of the second outer edge of the second radiating element extend in a same first direction, and wherein a horizontal separation between the first radiating element and the second radiating element remains substantially the same along the first portion of the first outer edge and the second portion of the second outer edge; and a transceiver coupled to the first radiating arm and the second radiating arm, the transceiver configured to provide a first signal to the first radiating element and a second signal to the second radiation element, wherein the second signal is orthogonally polarized with respect to the first signal.

10. The antenna apparatus of claim 9, wherein the horizontal separation is between 0.127 mm and 0.3 mm.

11. The antenna apparatus of claim 9, wherein the first radiating arm is vertically offset from the second radiating arm by 0.127 mm to 0.254 mm.

12. The antenna apparatus of claim 9, wherein the first signal is horizontally polarized and the second signal is vertically polarized.

13. An antenna apparatus comprising:

an antenna comprising:

a first radiating arm comprising a first radiating element comprising a first outer edge; and a second radiating arm that is orthogonal to the first radiating arm and vertically offset from the first radiating arm, the second radiating arm comprising a second radiating element having a second outer edge, wherein at least a first portion of the first outer edge of the first radiating element and a second portion of the second outer edge of the second radiating element extend in a same first direction, and wherein a horizontal separation between the first radiating element and the second radiating element remains substantially the same along the first portion of the first outer edge and the second portion of the second outer edge; and a transceiver coupled to the first radiating arm and the second radiating arm, the transceiver configured to provide a first signal to the first radiating element and a second signal to the second radiation element, wherein the antenna further comprises a conductive parasitic post that is vertically offset from the first radiating element.

14. The antenna apparatus of claim 13, wherein the conductive parasitic post is a first conductive parasitic post, and wherein the antenna further comprises a second conductive parasitic post that is vertically offset from the second radiating element.

15. The antenna apparatus of claim 14 wherein a first length of the first conductive parasitic post is different from a second length of the second conductive parasitic post.

16. The antenna apparatus of claim 9, wherein the antenna is a plurality of antennas.

17. The antenna apparatus of claim 9, wherein the first and second radiating arms are configured to support transmission from 24 GHz to 43.5 GHz.

18. The antenna apparatus of claim 9, further comprising a printed circuit board (PCB), wherein at least a portion of the PCB is between the first radiating arm and the second radiating arm.

* * * * *